US008786201B2

(12) United States Patent
Hamamoto et al.

(10) Patent No.: US 8,786,201 B2
(45) Date of Patent: Jul. 22, 2014

(54) LED LIGHTING DEVICE AND ILLUMINATION APPARATUS INCLUDING SAME

(75) Inventors: Katunobu Hamamoto, Neyagawa (JP); Masafumi Yamamoto, Kyoto (JP); Keisuke Ueda, Hirakata (JP); Hisaya Takikita, Habikino (JP)

(73) Assignee: Panasonic Corporation, Osaka (JP)

( * ) Notice: Subject to any disclaimer, the term of this patent is extended or adjusted under 35 U.S.C. 154(b) by 82 days.

(21) Appl. No.: 13/326,386

(22) Filed: Dec. 15, 2011

(65) Prior Publication Data

US 2012/0161649 A1 Jun. 28, 2012

(30) Foreign Application Priority Data

Dec. 28, 2010 (JP) ..... 2010-292761

(51) Int. Cl.
*H05B 37/02* (2006.01)

(52) U.S. Cl.
USPC ..... 315/187; 315/297

(58) Field of Classification Search
USPC ..... 315/187, 186, 185 R, 210, 217, 228, 315/244, 250, 297, 307
See application file for complete search history.

(56) References Cited

U.S. PATENT DOCUMENTS

| | | | | |
|---|---|---|---|---|
| 5,896,084 | A | 4/1999 | Weiss et al. | |
| 8,310,169 | B2 * | 11/2012 | Yu | 315/246 |
| 2006/0170287 | A1 | 8/2006 | Ito et al. | |
| 2007/0132407 | A1 | 6/2007 | Namba et al. | |
| 2007/0159750 | A1 | 7/2007 | Peker et al. | |
| 2009/0224695 | A1 | 9/2009 | Van Erp et al. | |
| 2010/0117559 | A1 * | 5/2010 | Lee | 315/294 |
| 2010/0225235 | A1 | 9/2010 | Nagase | |
| 2010/0264828 | A1 | 10/2010 | Cortigiani et al. | |

FOREIGN PATENT DOCUMENTS

| | | | |
|---|---|---|---|
| CN | 101534594 | A | 9/2009 |
| CN | 101842914 | A | 9/2010 |
| CN | 101480105 | B | 7/2011 |
| JP | 2006-210272 | A | 8/2006 |
| JP | 2008-210271 | | 8/2006 |
| JP | 2009-043447 | | 2/2009 |

OTHER PUBLICATIONS

Office Action dated Dec. 30, 2013 issued in corresponding Chinese application No. 201110441266.6 and the English translation thereof.
An extended European Search Report dated Apr. 16, 2014 issued in a corresponding European application No. 1101017.4-1807.

* cited by examiner

*Primary Examiner* — Daniel D Chang
(74) *Attorney, Agent, or Firm* — Bacon & Thomas, PLLC

(57) ABSTRACT

An LED lighting device includes a power converter for outputting a variable output voltage, two LED lamps being connected in series between output terminals of the power converter; a current detector for detecting an output current from the power converter; a first detector for detecting the output voltage of the power converter and generating a first detection voltage corresponding to the output voltage; a second detector for detecting an applied voltage to one of the two LED lamps and generating a second detection voltage corresponding to the applied voltage; and a controller for controlling the power converter to adjust the output voltage to thereby make the output current coincide with a target value. The controller controls the power converter to decrease the output voltage if at least one of the second detection voltage and the deference between the first and the second detection voltage does not fall within a range.

6 Claims, 4 Drawing Sheets

LED LIGHTING DEVICE AND ILLUMINATION APPARATUS INCLUDING SAME

FIELD OF THE INVENTION

The present invention relates to an LED (light emitting diode) lighting device for turning on an LED, and an illumination apparatus including same.

BACKGROUND OF THE INVENTION

Recently, an LED has begun to replace a fluorescent lamp as a light source. There is disclosed an LED lamp whose shape is similar to that of a straight tubular fluorescent lamp in, e.g., Japanese Patent Application Publication No. 2009-043447 (JP2009-043447A). This LED lamp includes a light source block formed by mounting a plurality of LEDs on a large plate-like mounting substrate; a straight glass tube in which the light source block is accommodated; pin bases sealing opposite ends of the glass tube; and terminal pins extended from the side surfaces of the pin bases to be used to supply a power to the light source block. The LED lamp is detachably mounted onto a lamp socket provided in a dedicated illumination apparatus and powered up through the lamp socket from an LED lighting device included in the illumination apparatus to thereby be turned on.

Further, a conventional example of the LED lighting device is disclosed in, e.g., Japanese Patent Application Publication No. 2006-210271. In the conventional example of the LED lighting device, a voltage (output voltage) applied to an LED lamp (lamp socket) and a current (output current) flowing through the LED lamp are detected. Then, a control (constant current control) adjusting the output voltage is performed in such a way that the output current is adjusted to be stabilized at a desired value (e.g., a rated current of the LED lamp).

If the power feeding based on the constant current control is continuously performed by the LED lighting device, when the LED lamp is broken down (e.g., open- or short-circuited), the output voltage may become abnormally increased to thereby exceed a rated voltage of the LED lamp or an excessive current may flow through the LED lamp. For that reason, in a conventional LED lighting device, an upper limit voltage and a lower limit voltage are respectively set to be sufficiently higher and lower than the rated voltage of the LED lamp and, if the output voltage applied to the LED lamp exceeds the upper limit voltage or falls below the lower limit voltage, the output voltage is reduced or the supply of the output voltage is stopped (lamp abnormality monitoring control).

As such, when a failure, e.g., open- or short-circuit occurs, due to aging degradation or the like in the LED lamp, the LED lighting device reduces the output voltage or stops the supply of the output voltage through the lamp abnormality monitoring control. Accordingly, it is possible to suppress excessive stresses from being applied to circuit components of the LED lighting device.

However, in case where two LED lamps are connected in series between output terminals of the LED lighting device and only the output voltage of the LED lighting device is monitored, the lamp abnormality monitoring control may be inappropriately carried out. For example, if an LED chip is open-circuited due to a breakdown in one of the LED lamps and an LED chip is short-circuited in the other LED lamp, a lamp voltage (forward voltage) of the former LED lamp is increased. In contrast, a lamp voltage (forward voltage) of the latter LED lamp is decreased. For that reason, even if both of the two LED lamps are in failure, the output voltage of the LED lighting device is not changed. Accordingly, the lamp abnormality monitoring control may be inappropriately functioned and, thus, the stopping of the supply or the reducing the output voltage of the LED lighting device may not be carried out.

SUMMARY OF THE INVENTION

In view of the above, the present invention provides an LED lighting device and an illumination apparatus including same, capable of performing an output control by reliably monitoring an abnormality of a plurality of LED lamps even when the LED lamps are turned on in series.

In accordance with an aspect of the present invention, there is provided an LED lighting device including a power converting unit for outputting a variable output voltage, two LED lamps being connected in series between output terminals of the power converting unit through two lamp sockets; a current detector for detecting an output current from the power converting unit; a first voltage detector for detecting the output voltage of the power converting unit and generating a first detection voltage corresponding to the output voltage; a second voltage detector for detecting an applied voltage to one of the two LED lamps and generating a second detection voltage corresponding to the applied voltage; and a control unit for controlling the power converting unit to adjust the output voltage to thereby make the output current coincide with a target value. The control unit controls the power converting unit to decrease the output voltage if at least one of the second detection voltage and the deference voltage between the first and the second detection voltage does not fall within a predetermined voltage range.

The control unit may accumulated lighting time of the LED lamps, and monotonously decreases an upper limit of the voltage range with an increase of the accumulated lighting time after the accumulated lighting time reaches a changeover time.

The control unit may the accumulated lighting time to zero when a reset condition is satisfied.

After the accumulated lighting time reaches a reset prohibition time which is greater than the changeover time, the control unit may not reset the accumulated lighting time even when the reset condition is satisfied.

In accordance with another aspect of the present invention, there is provided an illumination apparatus including the LED lighting device; two sets of lamp sockets; and an apparatus body in which the LED lighting device and the sets of lamp sockets are held.

In accordance with the present invention, it is possible to provide an LED lighting device and an illumination apparatus including the same, capable of performing an output control by reliably detecting an abnormality in a plurality of LED lamps even when the LED lamps are turned on in series.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Embodiments of the present invention will now be described with reference to the accompanying drawings which form a part hereof.

Figure 1:
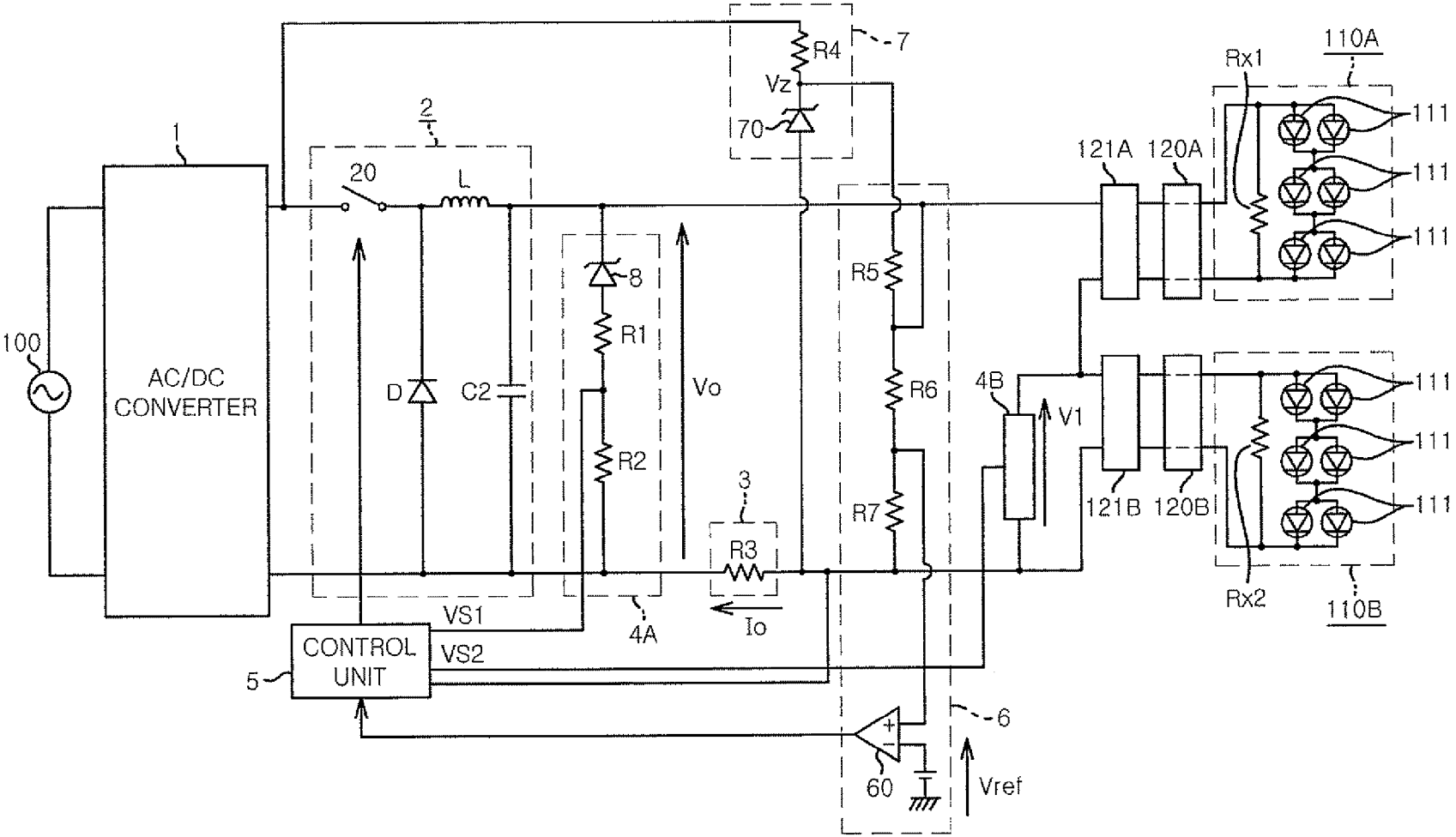
FIG. 1 is a circuit block diagram showing an LED lighting device in accordance with an embodiment of the present invention.

FIG. 1 is a circuit block diagram showing an LED lighting device in accordance with an embodiment of the present invention.

Figure 4A:
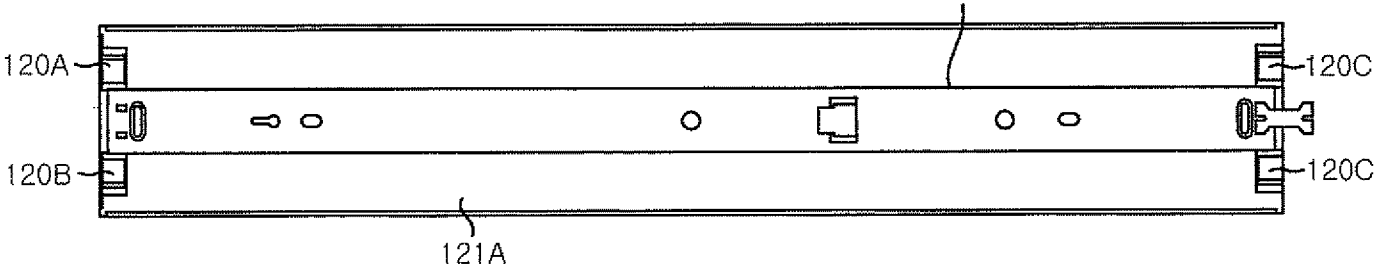
FIG. 4A to 4D are a plan view, a front view, a side view and a half cross sectional view, respectively, showing an exemplified illumination apparatus of the present invention.
Figure 4C:
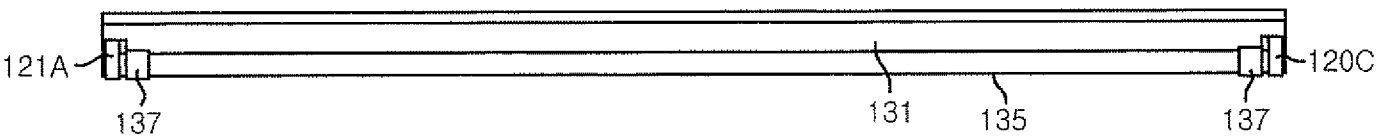
Figure 4D:
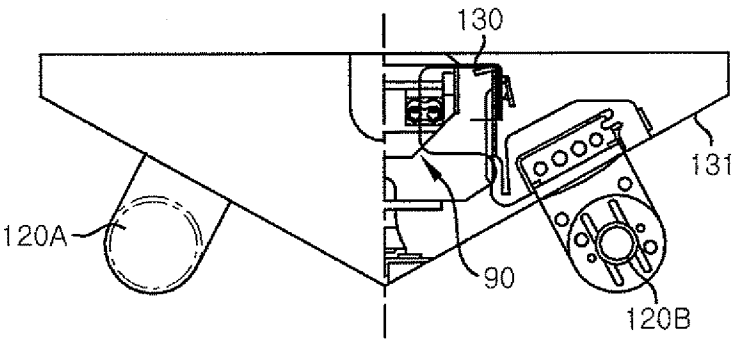
Figure 4B:
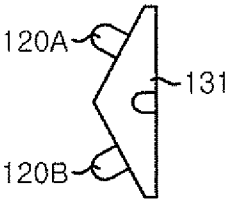

The LED lighting device of the present embodiment serves to light two LED lamps 110A and 110B each having a configuration that is similar to that of the LED lamp disclosed in JP2009-043447A. Specifically, each of the LED lamps 110A and 110B includes a series circuit of a plurality of sets of two parallel-connected light emitting diodes (LEDs) 111 (only three sets are shown in FIG. 1); resistors RX1 or RX2 connected to the series circuit; a straight glass tube 135 (see FIG. 4C); and two pin bases 137 sealing opposite ends of the glass tube 135. A pair of terminal pins (not shown) is protrudently provided on each pin base 137. Two terminal pins of each of the LED lamps 110A and 110B are respectively connected to output terminals of the LED lighting device through lamp socket 120A or 120B. A DC current (output current $I_o$) is supplied to the LEDs 111 through the lamp sockets 120A and 120E and the terminal pins connected thereto.

The LED lighting device of the present embodiment includes an AC/DC converter 1, a power converting unit 2, a current detector 3, a first voltage detector 4A, a second voltage detector 4B, a control unit 5, a connection determining unit 6, a constant voltage supply 7, and connectors 121A and 121B. The AC/DC convertor 1 includes, e.g., a step-up chopper circuit (power factor improving circuit) and serves to convert an AC voltage supplied from a commercial AC power source 100 to a desired DC voltage.

The power converting unit 2 has a well-known step-down chopper circuit including an inductor L, a diode D, a capacitor C2 and a semiconductor switching element 20 (hereinafter, simply referred to as "switching element") such as a bipolar transistor or a field effect transistor. Between output terminals of the power converting unit 2, a first connector 121A and a second connector 121B are connected in series. Lamp sockets 120A and 120B are respectively connected to the first and the second connector 121A and 121B in series. In other words, the two LED lamps 110A and 110B mounted on the lamp sockets 120A and 120B are connected in series between the output terminals of the power converting unit 2 through the connectors 121A and 121B and the lamp sockets 120A and 120B.

The first voltage detector 4A has a series circuit including voltage dividing resistors R1 and R2 and a zener diode 8 connected between the output terminals (opposite ends of the capacitor C2) of the power converting unit 2, and serves to detect an output voltage $V_0$ generated between the output terminals of the power converting unit 2. A first detection voltage VS1 (voltage in proportion to an output voltage $V_o$) divided by the voltage dividing resistors R1 and R2 is outputted from the first voltage detector 4A to the control unit 5.

The second voltage detector 45 serves to detect a voltage (lamp voltage) V1 applied to the LED lamp 110B through the connector 121B and the lamp socket 120B and outputs to the control unit 5 a second detection voltage VS2 in proportion to the lamp voltage V1. The second voltage detector 4B has the same circuit configuration as the first voltage detector 4A, and thus detailed description of the circuit configuration will be omitted.

The current detector 3 includes a detecting resistor R3 disposed between a negative potential output terminal of the power converting unit 2 and a negative port of the lamp socket 120B, and serves to detect an output current $I_o$ outputted from the power converting unit 2. A voltage drop in the detecting resistor R3 due to the output current $I_o$ is outputted as a detection voltage from the current detector 3 to the control unit 5.

The control unit 5 includes a control integrated circuit or a microcontroller and a memory, and serves to control the power converting unit 2 to decrease or increase the output voltage $V_o$ in such a way that the output current $I_o$ detected by the current detector 3 is adjusted to be stabilized at a target value.

In case that the control unit 5 is constituted by the microcontroller and the memory, the memory stores the rated current value of the LED lamps 110A and 110B in advance. The microcomputer (the control unit 5) obtains a magnitude (current value) of the output current $I_o$ corresponding to a detection voltage obtained from the current detector 3 and controls a duty ratio of a switching element 20 to decrease or increase the output voltage $V_o$ in such a way that the current value is adjusted to be stabilized at the rated current value (target value) stored in the memory. In other words, the control unit 5 performs a constant current control allowing a constant current (rated current) to flow through the LED lamps 110A and the 110B.

Here, the sum of the rated voltages of the LED lamps 110A and 110E is obtained by multiplying a forward voltage "Vf" of the LEDs 111 and the number "n" of the LEDs connected in series together (i.e., Vf×n). For example, when the forward voltage Vf is 3.5 V and the number n of the LEDs 111 connected in series (i.e., the number of the sets of the two parallel-connected LEDs 111) is 20, 70 V is obtained as the rated voltage by multiplying 3.5 and 20. When the number n of the LEDs 111 is 10, the rated voltage is 35 V by multiplying 3.5 and 10. Further, the control unit 5 may perform the constant current control in the range, e.g., at least from 35 V to 70 V so that a plurality of LED lamps having different rated voltages can be used.

Specifically, the control unit 5 performs a lamp abnormality monitoring control for monitoring whether at least one of the LED lamps 110A and 110B functions abnormally and for reducing or, preferably, stopping the output of the power converting unit 2 if at least one of the LED lamps 110A and 110B functions abnormally. For example, when the LED lamp 110A is broken down (at least one LED 111 therein is open- or short-circuited), the difference between the output voltage $V_o$ obtained from the first detection voltage VS1 and the lamp voltage V1 obtained from the second detection voltage VS2 exceeds a preset upper limit that is higher than the rated voltage of one LED lamp (it is assumed that the LED lamps 110A and 110B are identical) or becomes lower than a preset lower limit that is lower than the rated voltage. Similarly, when the LED lamp 110E is broken down, the lamp voltage V1 obtained from the second detection voltage VS2 detected by the second voltage detector 4B exceeds the preset upper limit or becomes lower than the preset lower limit. Therefore, the control unit 5 controls the power converting unit 2 in such a way that the supply of the output voltage is stopped when the difference ($=V_o-V1$) between the output voltage $V_o$ and the lamp Voltage V1 or the lamp voltage V1 is not within a predetermined normal range (predetermined voltage range from the lower limit to the upper limit).

The constant voltage supply 7 includes a resistor R4 having one end connected to a high potential output terminal of the AC/DC converter 1; and a zener diode 70 having a cathode connected to the other end of the resistor R4 and an anode connected to the negative port of the lamp socket 120B. A constant voltage (zener voltage Vz) generated between opposite sides (cathode and anode) of the zener diode 70 is applied to the connection determining unit 6. The zener voltage Vz applied from the constant voltage supply 7 needs to be smaller than the sum of the rated voltages of the LED lamps 110A and 110B. In order to use LED lamps having different rated voltages, it is preferable to set the zener voltage Vz to be smaller than the smallest sum of rated voltages of LED lamps which can be employed as the LED lamps 110A and 110B.

When the sum of the rated voltages of the LED lamps exceeds a dangerous voltage level and voltages divided by the resistors R5, R6 and R7 exceeds the dangerous voltage level, it is required that the zener voltage Vz applied from constant voltage supply 7 be lower than the dangerous voltage level. The dangerous voltage level may slightly vary depending on the standard of the LED lamp, but a DC voltage higher than DC 50 V is generally regarded as the dangerous voltage level.

The connection determining unit 6 includes a series circuit having three resistors R5, R6 and R7 connected between the cathode of the zener diode 70 and a negative port of the lamp socket 120B; and a comparator 60 for comparing a voltage drop by the resistor (detection resistor) R7 with a threshold voltage Vref. The connection mode between the two resistors R5 and R6 is connected to a positive port of the lamp socket 120A. In other words, the zener voltage Vz is applied to the lamp sockets 120A and 120B through the resistor R5 when both of the LED lamps 110A and 110B are connected to the LED lighting device.

When any one of the LED lamps 110A and 110E is not connected to the LED lighting device (unloaded condition), the zener voltage divided by the three resistors R5, R6 and R7 (voltage drop at the resistor R7) is inputted into a non-inverting input of the comparator 60. In contrast, when the lamp sockets 120A and 120E are connected with the LED lamps 110A and 1105 (loaded condition), resistors Rx1 and Rx2 of the LED lamp 110A and 110E are connected to the resistors R6 and R7 in parallel. Therefore, the voltage drop by the resistor R7 in the loaded condition becomes lower than that in the unloaded condition.

Here, the threshold voltage Vref that is inputted into an inverting input of the comparator 60 is set as a value between the voltage drop by the resistor R7 in the loaded condition and that in the unloaded condition, respectively. Accordingly, an output of the comparator 60 becomes an H level in the unloaded condition and an L level in the loaded condition. The output of the comparator 60 (determination result of the connection determining unit 6) is inputted to the control unit 5, so that the control unit 5 controls the power converting unit 2 to be operated or stops the operation of the converting unit 2 depending on the output of the comparator 60.

Next, an operation of the LED lighting device of the present embodiment will be described. First, once a power switch (not shown) is turned on to start to supply a power from a commercial AC power supply 100, the AC/DC converter 1 is operated to output a DC voltage. If the DC voltage high than the zener voltage Vz is outputted from the AC/DC converter 1, the constant zener voltage Vz from the constant voltage supply 7 is applied to the connection determining unit 6 and to the lamp sockets 120A and 120B through the resistor R5 when both of the LED lamps 110A and 110E are loaded to the LED lighting device.

Here, if the zener diode 8 is not provided, not only the series circuit having the two resistors R6 and R7 of the connection determining unit 6 but also the series circuit having the voltage dividing resistors R1 and R2 of the first voltage detector 4A are connected between the output terminals of the AC/DC converter 1 while the operation of the power converting unit 2 is stopped. Then, while an output voltage of the AC/DC converter 1 is gradually increased after it is operated, it takes a relatively longer time for a voltage at a connection node between the resistors R4 and R5 to reach the zener voltage Vz of the zener diode 70 (i.e., it takes longer for an output voltage of the constant voltage supply 7 to become stable).

However, in accordance with the present embodiment, the zener diode 8 having a zener voltage that is higher than that of the zener diode 70 is connected to a connection mode between the first voltage detector 4A and the positive (high) potential terminal of the power converting unit 2. For that reason, while the output voltage of the AC/DC converter 1 is gradually increased, the first voltage detector 4A is separated from the connection determining unit 6 and the constant voltage supply 7 until a voltage at a connection mode between the resistors R5 and R6 is increased above the zener voltage Vz of the zener diode 8. In other words, it is possible to shorten the time period during which the output voltage of the constant voltage supply 7 becomes stable as compared with the case where the zener diode 8 is not provided.

Further, the second voltage detector 4B includes a zener diode having a zener voltage that is higher than that of the zener diode 70 like the first voltage detector 4A. For that reason, the second voltage detector 4B is separated until a voltage at a connection mode between the resistor Rx1 of the LED lamp 110A and the resistor Rx2 of the LED lamp 110B is increased over the zener voltage that is higher than that of the zener diode 70.

Then, once the output voltage of the constant voltage supply 7 becomes stable, the connection determining unit 6 determines whether the connection is in the loaded condition or in the unloaded condition. In the case of the loaded condition as the result of the determination, the control unit 5 operates the power converting unit 2 to start the constant current control. On the other hand, in the case of the unloaded condition as the result of the determination, the control unit 5 does not operate the power converting unit 2.

If a voltage that exceeds the sum of the rated voltages of the LED lamp 110A and 110B is outputted from the power converting unit 2 in the unloaded condition, an excessive current that exceeds a rated value may flow immediately after the LED lamps 110A and 110B are respectively connected to the lamp sockets 120A and 120B. However, in the present embodiment, the control unit 5 stops the operation of the power converting unit 2 until the connection determining unit 6 determines the connection condition of the LED lamps 110A and 110B. Then, when the connection determining unit 6 determines the connection as the loaded condition, the control unit 5 starts to operate the power converting unit 2. Accordingly, the voltage that exceeds the rated level is not applied to the LED lamps 110A and 110B. As a result, a current flowing when the LED lamps 110A and 110E are respectively mounted on the lamp sockets 120A and 120B is regulated to a desired level and, thus, it is possible to prevent the breakdown of the LED lamps 110A and 110B.

Next, the case that one of the LED lamps 110A and 110B is broken down while the power converting unit 2 is operated will be described.

For example, in case that one of two LEDs 111 connected in parallel in the LED lamp 110A is open-circuited, a current flowing through the LED lamps 110A and 110B is temporally reduced, and the output voltage $V_o$ of the power converting unit 2 is raised since the control unit 5 continuously carries out the constant current control. If one of two LEDs 111 connected in parallel in the LED lamp 110E is short-circuited at this moment, a current flowing through the LED lamps 110A and 110B is temporally increased and the output voltage $V_o$ of the power converting unit 2 is reduced since the control unit 5 continuously carries out the constant current control.

Eventually, when the open-circuit and the short-circuit occur simultaneously, the output voltage $V_o$ of the power converting unit 2 may be substantially the same as in the case before breakdown.

In the present embodiment, however, the control unit 5 determines that the LED lamp 110B is broken down and stops the operation of the power converting unit 2 if the voltage applied to the LED lamp 110B where the short-circuit occurs is decreased below the lower limit. Similarly, the control unit 5 determines that the LED lamp 110A is broken down and stops the operation of the power converting unit 2 if the voltage applied to the LED lamp 110A where the open-circuit occurs is increased over the upper limit.

As described above, when open- or short-circuit occurs in the LED lamp 110A or 110B, the control unit 5 stops the operation of the power converting unit 2 and, thus, it is possible to prevent continuous use of the broken-down LED lamp 110A or 110B. Further, in the present embodiment, the output control can be performed by reliably detecting abnormal conditions of the LED lamps 110A and 110E even when a plurality of LED lamps 110A and 110B connected in series are turned on.

In the present embodiment, in the case of the unloaded condition or the breakdown, the control unit 5 stops the operation of the power converting unit 2. However, it is not necessary to stop the operation of the power converting unit 2. For example, in the case of the unloaded condition or the breakdown, the control unit 5 may control the power converting unit 2 so that the output voltage $V_o$ is limited to a level far below the lower limit that is lower than the rated voltages of the LED lamps 110A and 110B. Further, the connection determining unit 6 may determine whether the connection condition is the unloaded level or the loaded level after the commercial AC power supply 100 is started to supply a power. Then, in the case of the loaded condition as the result of the determination, the control unit 5 may operate the AC/DC converter 1 and the power converting unit 2.

Figure 2A:
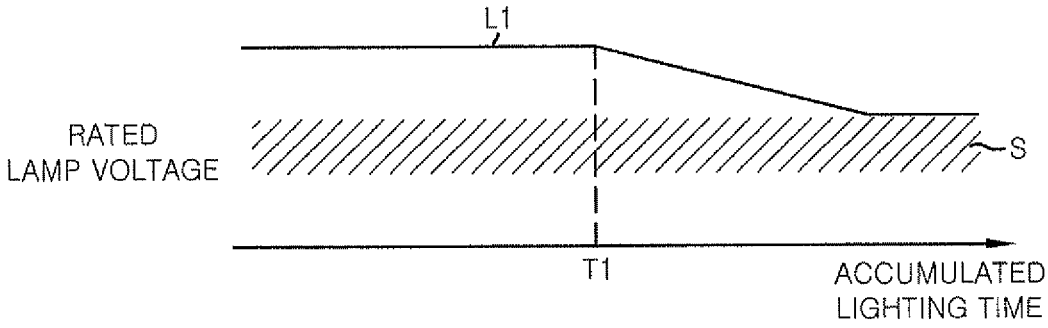
FIGS. 2A to 2C are graphs for explaining the relationship between an accumulated lighting time period and an upper limit voltage in the LED lighting device.

The control unit 5 counts accumulated lighting time of the LED lamps 110A and 110E by using a timer provided in the microcontroller and monotonously decreases the upper limit employed in determining the abnormality of the LED lamps 110A and 110B after the accumulated lighting time (horizontal axis) reaches a preset changeover time T1 as shown in FIG. 2A by a solid line L1. Here, each hatched area "S" shown in FIGS. 2A to 2C indicates the rated voltage range of the LED lamps 110A and 110E with individual variability. Moreover, it is preferable to set the changeover time T1 as a time period that is approximately identical to a rated lifespan of the LED lamp (a lifespan defined by brightness decay or a rated lifespan of circuit parts included in the LED lamp) or a rated lifespan of the LED lighting device (a rated lifespan of circuit parts included in the LED lighting device).

As described above, after the accumulated lighting time reaches the changeover time T1, the upper limit employed in determining the abnormality of the LED lamps 110A and 110B is monotonously decreased with time. Therefore, it is possible to quickly reliably detect a breakdown of the LED lamps 110A and 110E caused by aging deterioration even when the LED lamps 110A and 110E have been used for a long period of time that approximately exceeds the rated lifespan of the illumination apparatus (LED lighting device). Here, it is not necessary for the control unit 5 to linearly reduce the upper limit. For example, the control unit 5 may reduce the upper limit in a stepwise manner.

Figure 2B:
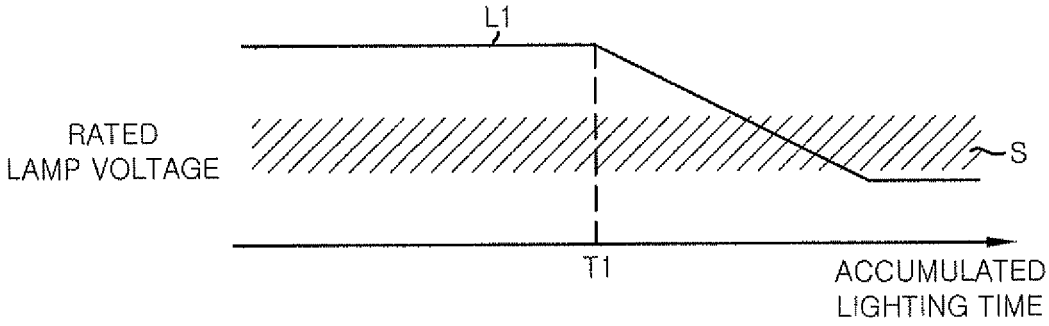
Figure 2C:
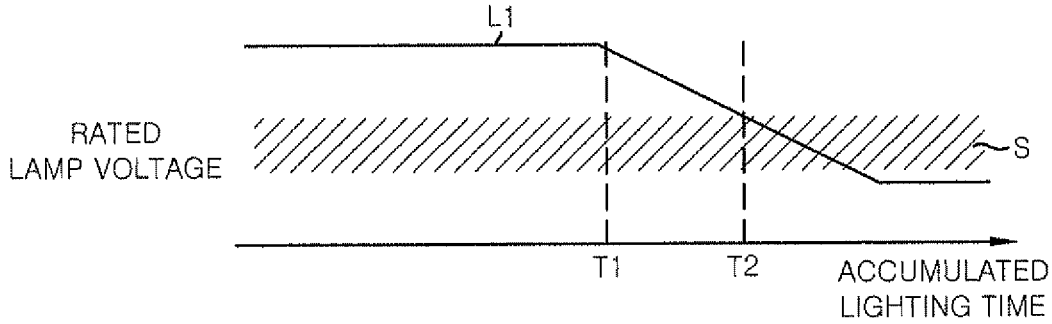

Moreover, as shown in FIG. 2A by the solid line L1, the control unit 5 maintains the upper limit to be greater than the rated voltage (area S) of the LED lamps 110A and 110B. As shown in FIG. 2B by the solid line L1, however, the upper limit may be reduced to be equal to or smaller than the rated voltage (area S) of the LED lamps 110A and 110B.

Here, the control unit 5 resets the accumulated lighting time to zero when a preset reset condition is satisfied. For example, the reset condition is satisfied when the power converting unit 2 is operated again after it is stopped since the voltage applied to the LED lamp 110A or 110B is increased above the upper limit, and then the connection determining unit 6 determines the loaded condition after determining the unloaded condition (replacement of the LED lamp 110A or 110B). However, in case that the control unit 5 reduces the upper limit to be equal to or smaller than the rated voltage (area S) of the LED lamps 110A and 110B, at is preferable not to reset the accumulated lighting time after a time (reset prohibition time) T2 at which the solid line L1 of the upper limit is intersected with the area S even when the reset condition is satisfied.

For example, if the LED lighting device that has been used for a long period of time that exceeds the reset prohibition time T2, and is continuously used more, it is more likely that various functional errors are made in the LED lighting device. For that reason, when the LED lamps 110A and 110B is replaced with a new one, the LED lamps 110A and 110B may not be turned on unless the accumulated lighting time is reset. This makes it possible to urge a user to replace the LED lighting device (illumination apparatus) with a new one. Further, it is possible to prevent all the LED lamps from being turned off simultaneously in a general business office or the like due to variations in timings, at which the LED lamps are turned off, caused by their different aging deteriorated levels and the upper limit monotonously decreased with time.

Figure 3C:
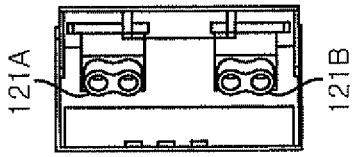
FIGS. 3A to 3C show outer appearances of the LED lighting device.
Figure 3A:
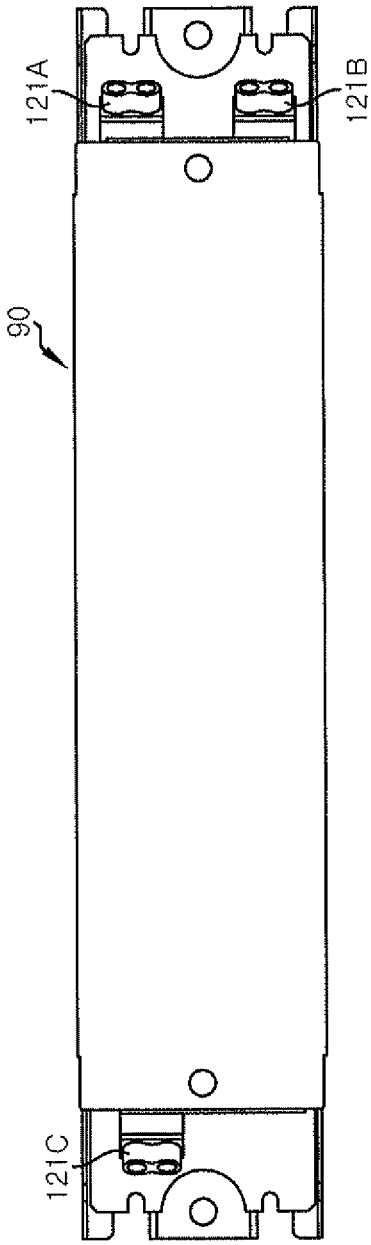
Figure 3B:
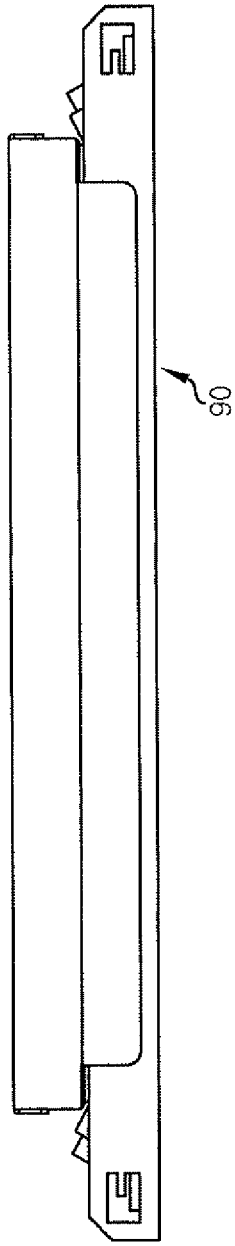

As shown in FIGS. 3A to 3C, the LED lighting device of the present embodiment is accommodated in a metal case 90. Connectors 121A and 121B are provided at one end side of the case 90 in its longitudinal direction, and are respectively connected to the lamp sockets 120A and 120B. Further, a connector 121C is provided at the other end side of the case 90 in its longitudinal direction, and is connected to the commercial AC power supply 100.

Moreover, the LED lighting device accommodated in the case 90 is mounted in, e.g., an illumination apparatus as shown in FIGS. 4A to 4D. The illumination apparatus includes, e.g., an apparatus body 130 directly attached to the ceiling; and a pair of lamp sockets 120A and 120E serving to supply a power and provided in the apparatus body 130; and a pair of lamp sockets 120C provided in the apparatus body 130 for grounding.

The apparatus body 130 is made of a metal plate having a substantially rectangular shape in the plan view, and the pair of lamp sockets 120A and 120B for supplying a power and the pair of lamp sockets 120C for grounding are respectively attached to one end side and the other end side of the apparatus body 130 in its longitudinal direction. Further, the LED lighting device accommodated in the case 90 is attached to a lower side of the apparatus body 130. A reflection plate 131 having a substantially triangular shape when viewed in the longitudinal direction of the apparatus body 130 is attached to a lower side of the apparatus body 130. The LED lamps 110A and 110E are arranged under the reflection plate 131. Here, since the lamp sockets 120A and 120B have the same structure as the lamp sockets of the conventionally straight tubular fluorescent lamp, a DC current may be supplied to its filament when the fluorescent lamp is erroneously mounted to the lamp sockets 120A and 120B.

In the present embodiment, however, the operation of the power converting unit 2 is stopped as described above when the voltage detected by the voltage detector 4B falls below the preset lower limit which is less than the rated voltage. Accordingly, even when the fluorescent lamp is erroneously mounted, an unsafe phenomenon and/or breakdown of the lighting device do not occur, for example. Here, a user cannot recognize whether such erroneous mounting may cause a safe or an unsafe condition. For that reason, the pin bases of the LED lamps 110A and 110B may be made to have electrode shapes that are different from those of the fluorescent lamp to prevent the erroneous mounting, and the lamp sockets 120A, 120B and 1200 may be formed conforming to the pin base shape of the LED lamps 110A and 110B.

In case that LED lamp pin bases, lamp sockets and the like included in the illumination apparatus are formed of resin materials, the changeover time T1 may be appropriately set in such a way that an unsafe phenomenon does not occur due to aging deterioration of resin materials.

In the embodiment described above, the lamp abnormality monitoring control is carried out by using the output voltage $V_o$ of the power control unit 2 and the lamp voltage V1 applied to one of the LED lamps 110A and 110B. However, the lamp abnormality monitoring control may be carried out based on the detection voltage difference (=VS1−VS2) and the detection voltage VS2 directly. In such a case, the normal range needs to be modified appropriately according to the change in the basis of the abnormality determination.

While the invention has been shown and described with respect to the embodiments, it will be understood by those skilled in the art that various changes and modifications may be made without departing from the scope of the invention as defined in the following claims.

What is claimed is:

1. An LED lighting device comprising:

a power converting unit for outputting a variable output voltage, two LED lamps being connected in series between output terminal of the power converting unit through lamp sockets;

a current detector for detecting an output current from the power converting unit;

a first voltage detector for detecting the output voltage of the power converting unit and generating a first detection voltage corresponding to the output voltage;

a second voltage detector for detecting an applied voltage to one of the two LED lamps and generating a second detection voltage corresponding to the applied voltage; and a control unit for controlling the power converting unit to adjust the output voltage to thereby make the output current coincide with a target value, wherein the control unit controls the power converting unit to decrease the output voltage if at least one of the second detection voltage and the difference voltage between the first and the second detection voltage does not fall within a predetermined voltage range, wherein the control unit counts accumulated lighting time of the LED lamps, and monotonously decreases an upper limit of the voltage range with an increase of the accumulated lighting time after the accumulated lighting time reaches a changeover time.

2. The LED lighting device of claim 1, wherein the control unit resets the accumulated lighting time to zero when a reset condition is satisfied.

3. The LED lighting device of claim 2, wherein, after the accumulated lighting time reaches a reset prohibition time which is greater than the changeover time, the control unit does not reset the accumulated lighting time even when the reset condition is satisfied.

4. An illumination apparatus, comprising:

the LED lighting device of claim 3;

two pairs of lamp sockets; and an apparatus body by which the LED lighting device and the lamp sockets are held.

5. An illumination apparatus, comprising:

the LED lighting device of claim 2;

two pairs of lamp sockets; and an apparatus body by which the LED lighting device and the lamp sockets are held.

6. An illumination apparatus, comprising:

the LED lighting device of claim 1;

two pairs of lamp sockets; and an apparatus body by which the LED lighting device and the lamp sockets are held.

* * * * *